US007261676B2

(12) United States Patent
Liou

(10) Patent No.: US 7,261,676 B2
(45) Date of Patent: Aug. 28, 2007

(54) EXERCISER HAVING IMPROVED RESISTIVE DEVICE

(76) Inventor: Jiann Bang Liou, P.O. Box 63-298, Taichung (TW) 406

( * ) Notice: Subject to any disclaimer, the term of this patent is extended or adjusted under 35 U.S.C. 154(b) by 649 days.

(21) Appl. No.: 10/810,480

(22) Filed: Mar. 26, 2004

(65) Prior Publication Data

US 2004/0180761 A1 Sep. 16, 2004

Related U.S. Application Data

(63) Continuation-in-part of application No. 10/043,845, filed on Jan. 14, 2002, now Pat. No. 6,761,670.

(51) Int. Cl.
*A63B 69/06* (2006.01)

(52) U.S. Cl. ..... 482/72; 482/57

(58) Field of Classification Search ..... 482/72–73, 482/56–57, 127, 52, 900
See application file for complete search history.

(56) References Cited

U.S. PATENT DOCUMENTS 2,131,570 A * 9/1938 Riley ..... 482/72
2,512,911 A * 6/1950 Benice ..... 482/72
5,916,069 A * 6/1999 Wang et al. ..... 482/72
6,090,017 A * 7/2000 Wang ..... 482/72
6,273,845 B1 8/2001 Liou ..... 482/63
6,488,611 B1 * 12/2002 Ambrosina et al. ..... 482/63
6,761,670 B2 * 7/2004 Liou ..... 482/72

* cited by examiner

*Primary Examiner*—Jerome Donnelly
*Assistant Examiner*—Fenn C. Mathew

(57) ABSTRACT

An exerciser includes a shaft rotatably disposed on a base, a housing rotatably engaged on the shaft and having a chamber formed by an outer peripheral wall which has a groove, a belt wound around the tube for rotating the housing, a barrel received in the chamber of the housing and secured to the shaft and having a slot. A coil spring is received in the housing and has two ends engaged into the slot of the barrel and the groove of the outer peripheral wall of the housing. A cover includes a space formed by an outer peripheral fence, to suitably enclose the chamber of the housing.

14 Claims, 5 Drawing Sheets

EXERCISER HAVING IMPROVED RESISTIVE DEVICE

The present invention is a continuation-in-part of U.S. patent application Ser. No. 10/043,845, filed 14 Jan. 2002, now U.S. Pat. No. 6,761,670.

BACKGROUND OF THE INVENTION

1. Field of the Invention

The present invention relates to an exerciser, and more particularly to an exerciser having an improved resistive device for suitably applying resistive forces to against the driving device of the exerciser.

2. Description of the Prior Art

Various kinds of typical exercise apparatus have been developed and comprise a resistive device coupled to a driving device, in order to provide a resistive force against the driving device.

For example, U.S. Pat. No. 2,512,911 to Benice disclose two of the typical exercise machines comprising a coil spring type resistive device received in a drum, to provide the resistive force against a pulling type driving device. The drum of the typical exercise machines do not enclosed or sealed such that no grease or lubrication oil may be received in the drum to lubricate the coil spring.

U.S. Pat. No. 5,916,069 to Wang et al. discloses another typical exercise machine comprising a magnetic resistive device in addition to a coil spring type resistive device, to provide the resistive force against a pulling type driving device. Similar, the coil spring may not be enclosed and sealed within a driving wheel, such that grease or lubrication oil may flow out of the driving wheel.

The present applicant has also developed a typical exercise machine comprising a magnetic resistive device for providing the resistive forces against a cycling exerciser, and disclosed in U.S. Pat. No. 5,916,069 to Liou. However, the typical exercise machine also fail to disclose a resistive device including a coil spring type resistive device in addition to the magnetic resistive device.

U.S. Pat. No. 6,488,611 to Ambrosina et al. discloses a further typical exercise machine comprising a fluid resistance device to provide an impeller actuated resistive force against a driving device. However, a housing is required to be completely sealed to receive the fluid, and to prevent the fluid from flowing out of the housing, such that a complicated water sealing structure is required to be provided or formed in the housing. Furthermore, the typical exercise machine also fail to disclose a resistive device including a coil spring type resistive device received in a fluid tight sealed housing.

The present invention has arisen to mitigate and/or obviate the afore-described disadvantages of the conventional exercisers.

SUMMARY OF THE INVENTION

The primary objective of the present invention is to provide an exerciser including an improved resistive device having a coil spring received in a suitably enclosed housing, for allowing the coil spring to be suitably lubricated with grease or lubrication oil or the like.

In accordance with one aspect of the invention, there is provided an exerciser comprising a base including a shaft provided thereon, a housing rotatably engaged onto and supported on the shaft, and including a tube extended therefrom and rotatably engaged on the shaft, the housing including a chamber formed therein and defined by an outer peripheral wall which includes a groove formed therein, a belt engaged onto and wound around the tube of the housing, for rotating the housing relative to the shaft, a barrel received in the chamber of the housing, and secured to the shaft and rotated in concert with the shaft, the barrel including a slot formed therein, a coil spring received in the chamber of the housing, and including a first end engaged into the slot of the barrel, and a second end engaged into the groove of the outer peripheral wall of the housing, to apply a spring biasing force against the housing, and a cover including a space formed therein and defined by an outer peripheral fence, to receive the housing, and to allow the housing to be received in the space of the peripheral fence of the cover, and to allow the chamber of the housing to be suitably enclosed by the cover.

A rotary wheel may further be provided and rotatably attached onto the shaft and secured to the housing. The rotary wheel is a preferably magnetic rotary wheel. The housing includes an opening formed in the tube, the rotary wheel includes a hub extended therefrom and engaged into the opening of the tube of the housing, and secured to the tube.

A rotating member may further be provided and rotatably attached onto the shaft and selectively secured to the housing when the rotary wheel is disengaged from the housing.

The housing includes at least one second groove formed in the outer peripheral wall thereof for selectively receiving the second end of the coil spring. Each of the grooves of the housing includes a curved structure. The grooves of the housing are arranged in opposite direction. The groove of the outer peripheral wall of the housing is preferably formed within the outer peripheral wall of the housing and not formed through the outer peripheral wall of the housing.

The housing includes at least one flat surface formed in the outer peripheral wall thereof and having a screw hole formed therein, the cover includes at least one flat surface formed therein and having an orifice formed therein, the flat surface of the cover is engaged with the flat surface of the outer peripheral wall of the housing, to align the orifice of the cover with the screw hole of the housing.

The housing includes at least one cavity formed in the outer peripheral wall thereof. The housing includes at least one partition provided in the outer peripheral wall thereof, to define the cavity thereof.

A plate may further be provided and secured onto the tube of the housing, to form the tube of the housing as a pulley, and to retain the belt on the tube.

The shaft includes at least one flat surface formed thereon, the barrel includes at least one flat surface formed therein and engaged with the flat surface of the shaft, to secure the barrel on the shaft and to prevent the barrel from being rotated relative to the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
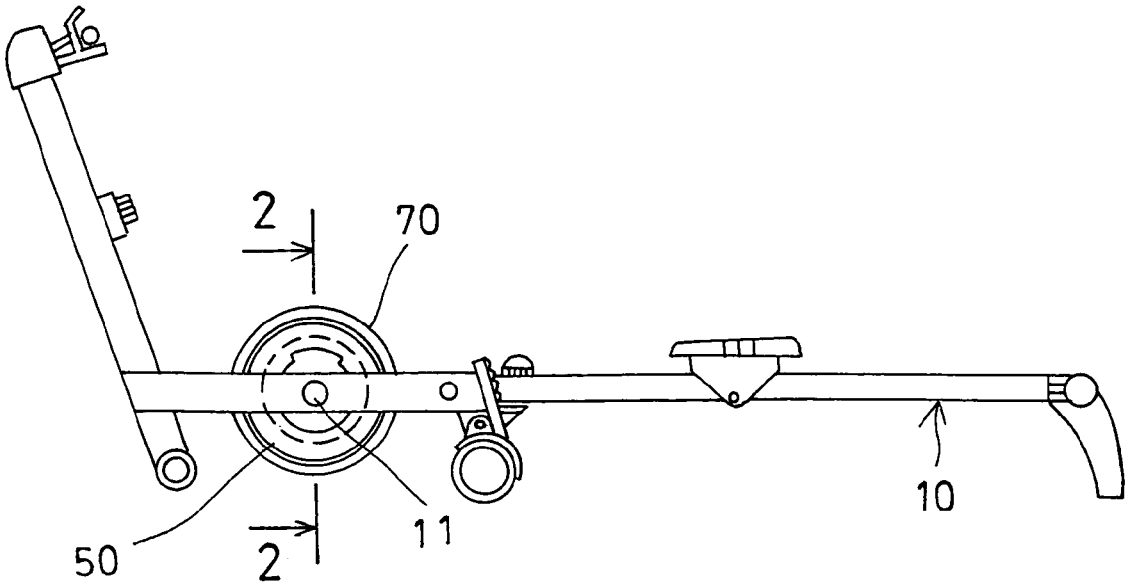
FIG. 1 is a plan schematic view of an exerciser having a resistive device in accordance with the present invention.
Figure 2:
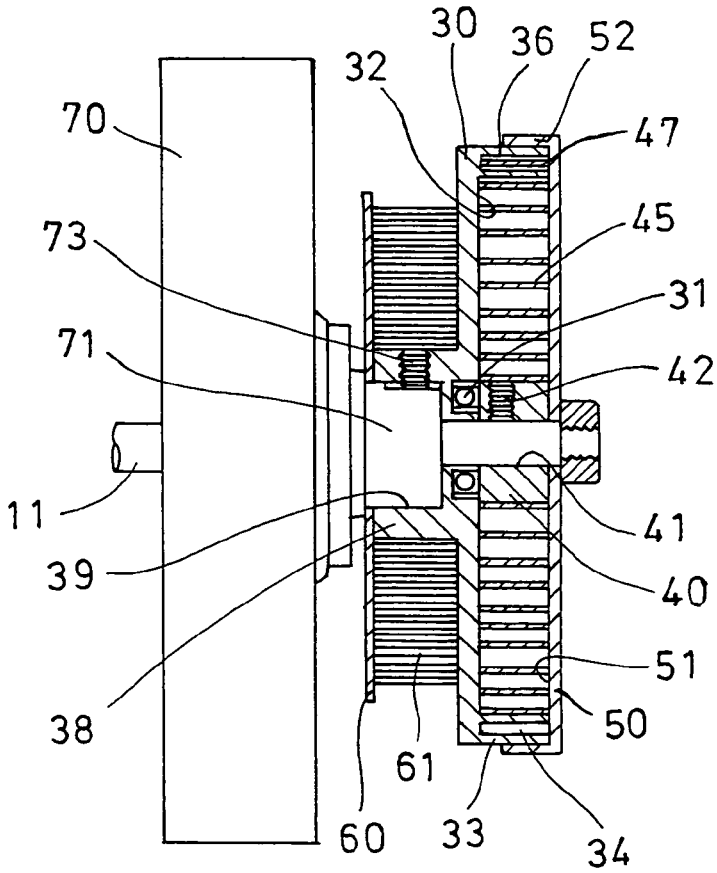
FIG. 2 is a partial cross sectional view of the exerciser, taken along lines 2—2 of FIG. 1.

Referring to the drawings, and initially to FIGS. 1–4, an exerciser in accordance with the present invention comprises a base 10 including a shaft 11 laterally disposed therein and having one or more flat surfaces 12 formed or provided thereon, and a housing 30 rotatably secured onto the shaft 11 with one (FIGS. 1, 5) or more (FIG. 7) bearings 31.

The housing 30 includes a chamber 32 formed therein and defined by an outer peripheral wall 33. The outer peripheral wall 33 includes one or more cavities 34 formed therein and defined by one or more partitions 35, for such as weight reducing purposes, and includes one or more, such as two opposite curved or C-shaped grooves 36 formed therein.

A barrel 40 includes a non-circular bore 41 formed therein to receive the portions of the shaft 11 having the flat surfaces 12 formed thereon, and to allow the barrel 40 to be rotated in concert with the shaft 11. The barrel 40 is received in the chamber 32 of the housing 30, and may further be solidly secured to the shaft 11 with one or more fasteners 42, and may include a slot 43 formed therein.

A coil spring 45 is received in the chamber 32 of the housing 30, and includes one end 46 engaged into and positioned in the slot 43 of the barrel 40, and the other end 47 selectively engageable into either of the grooves 36 of the outer peripheral wall 33 of the housing 30, such that the coil spring 45 may be coupled between the housing 30 and the shaft 11, to apply a resistive force and/or a recovering force against the housing 30.

It is to be noted that the other end 47 of the coil spring 45 may be selectively engaged into either of the grooves 36 of the outer peripheral wall 33 of the housing 30, to allow the coil spring 45 to be disposed in different or opposite position or direction, and thus to allow the coil spring 45 to be easily engaged into the chamber 32 of the housing 30, and to be easily assembled between the housing 30, and the barrel 40.

It is further to be noted that the grooves 36 are formed within the outer peripheral wall 33 of the housing 30, and are not formed through the outer peripheral wall 33 of the housing 30, such that the outer peripheral wall 33 of the housing 30 may include an enclosed or sealed outer peripheral structure having no openings or passages formed therein.

A cover 50 is further provided and includes a space 51 formed therein and defined by an outer peripheral fence 52, for receiving or for engaging onto the housing 30, or for allowing the housing 30 to be received in the space 51 of the peripheral fence 52. The cover 50 may be solidly secured to the housing 30 with one or more fasteners 54.

It is preferable that the housing 30 includes one or more flat surfaces 37 formed or provided thereon, and each having a screw hole 371 formed therein. It is preferable that the cover 50 includes one or more flat surfaces 53 formed or provided thereon, and each having an orifice 55 formed therein for aligning with the screw holes 371 of the housing 30.

The engagement of the flat surfaces 53 of the cover 50 with the flat surfaces 37 of the housing 30 may suitably align the screw holes 371 of the housing 30 with the orifices 55 of the cover 50, for allowing the fasteners 54 to easily engage through the orifices 55 of the cover 50, and then to suitably thread with the screw holes 371 of the housing 30.

It is to be noted that the engagement of the peripheral fence 52 of the cover 50 onto the housing 30 may suitably enclose or seal the chamber 32 of the housing 30, and may suitably retain the grease or lubrication oil or the like within the chamber 32 of the housing 30, and thus to prevent the grease or lubrication oil or the like from flowing out of the chamber 32 of the housing 30, and to allow the coil spring 45 to be suitably lubricated by the grease or lubrication oil or the like.

Figures 3, 4:
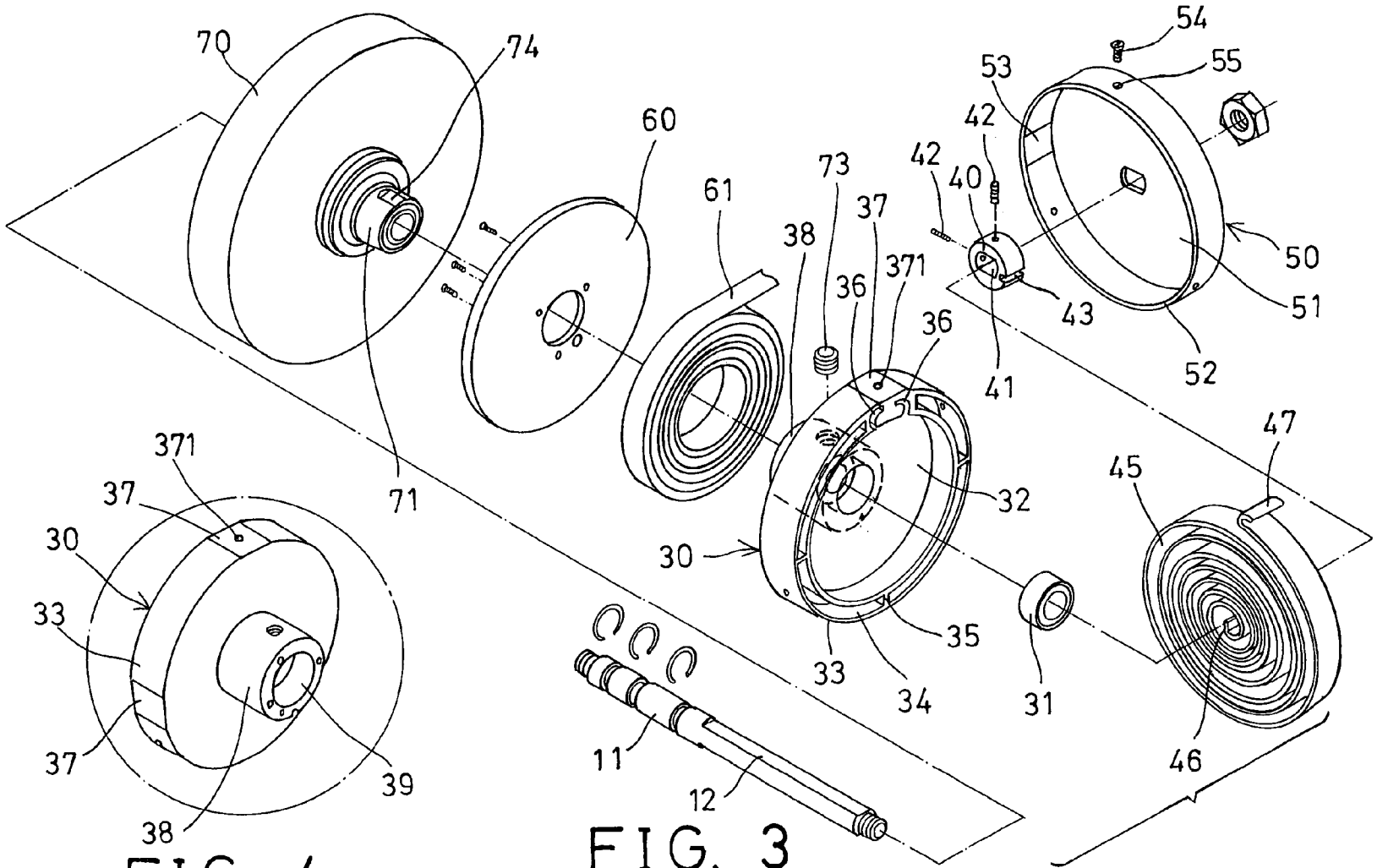
FIG. 3 is a partial exploded view of the resistive device for the exerciser.
FIG. 4 is a perspective view illustrating a housing for receiving a coil spring of the exerciser.

The housing 30 includes a tube 38 laterally extended therefrom and rotatably engaged on the shaft 11, and having an opening 39 formed therein (FIG. 4). A rotary wheel 70 is also engaged onto the shaft 11, and includes a hub 71 extended therefrom and engaged into the opening 39 of the tube 38 of the housing 30, and secured to the tube 38 with one or more fasteners 73.

It is preferable that the hub 71 of the rotary wheel 70 includes one or more flat surfaces 74 formed or provided thereon, for engaging with the fasteners 73, and for solidly securing the hub 71 to the tube 38 of the housing 30, and for preventing the rotary wheel from being rotated relative to the tube 38 of the housing 30.

It is preferable that the rotary wheel 70 is a magnetic rotary wheel 70, or may include a magnetic retarding or resisting device (not shown) provided therein, to provide or to apply a magnetic retarding or resisting force against the rotary wheel 70 and thus to further provide a resistive force against the users. One example of the magnetic retarding or resisting device has been disclosed in the applicant's U.S. Pat. No. 5,916,069 to Liou, which may be taken as a reference for the present invention.

A plate 60 may be secured onto the outer or free end of the tube 38 of the housing 30 with one or more fasteners, to allow the tube 38 of the housing 30 to be formed as a pulley, and to allow a belt 61 to be engaged onto and wound around the tube 38 of the housing 30. The belt 61 may be used to pull and to rotate the housing 30 relative to the shaft 11 (FIG. 8).

Figure 5:
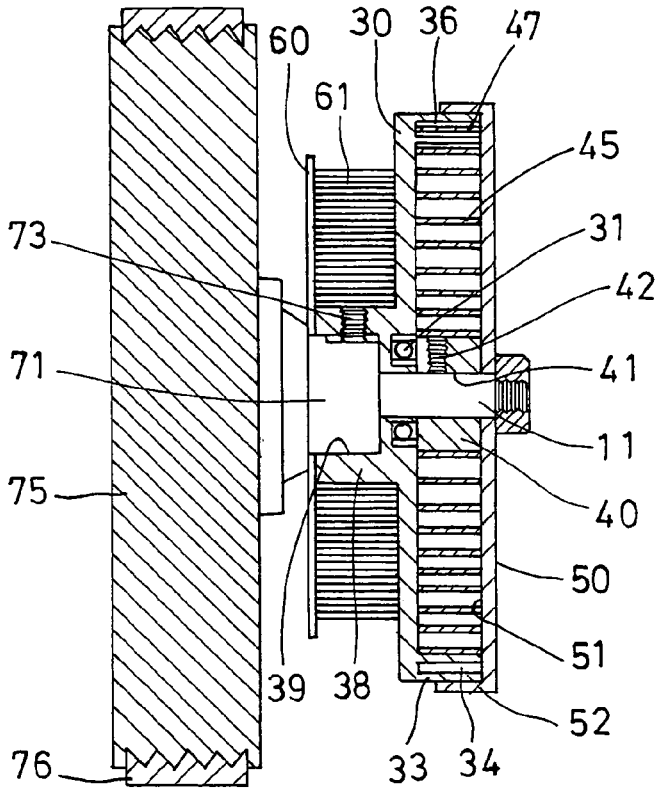
FIG. 5 is a partial cross sectional view similar to FIG. 2, illustrating the other arrangement or application of the exerciser.

As shown in FIG. 5, when the rotary wheel 70 is disengaged from the housing 30 and the shaft 11, a sprocket or a pulley or a rotating member 75 may alternatively be provided and may also include a hub 71 extended therefrom and engaged into the opening 39 of the tube 38 of the housing 30, and secured to the tube 38 with one or more fasteners 73. A driving chain or belt 76 may be engaged onto or around the rotating member 75 to drive or to rotate the rotating member 75 and thus the housing 30.

Figure 6:
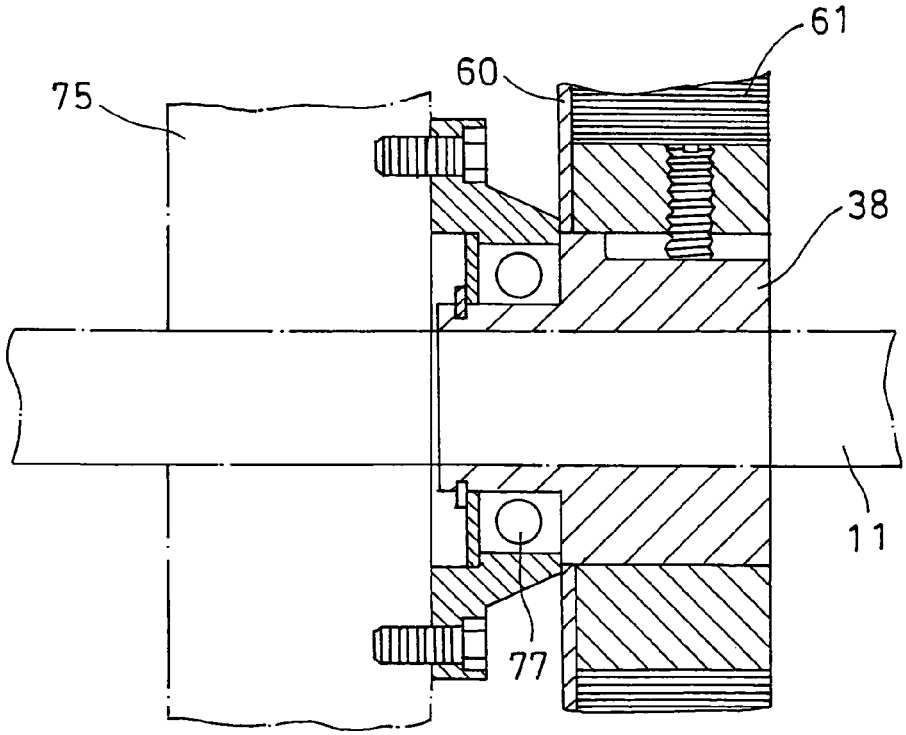
FIG. 6 is another partial cross sectional view similar to FIGS. 2 and 5, illustrating another arrangement or application of the exerciser.

As shown in FIG. 6, the rotating member 75 may alternatively be rotatably secured onto the tube 38 of the housing 30 with a unidirectional bearing 77, for allowing the rotating member 75 to drive or to rotate the tube 38 of the housing 30 in an active direction, but to rotate freely relative to the tube 38 of the housing 30 in a reverse direction.

Figure 7:
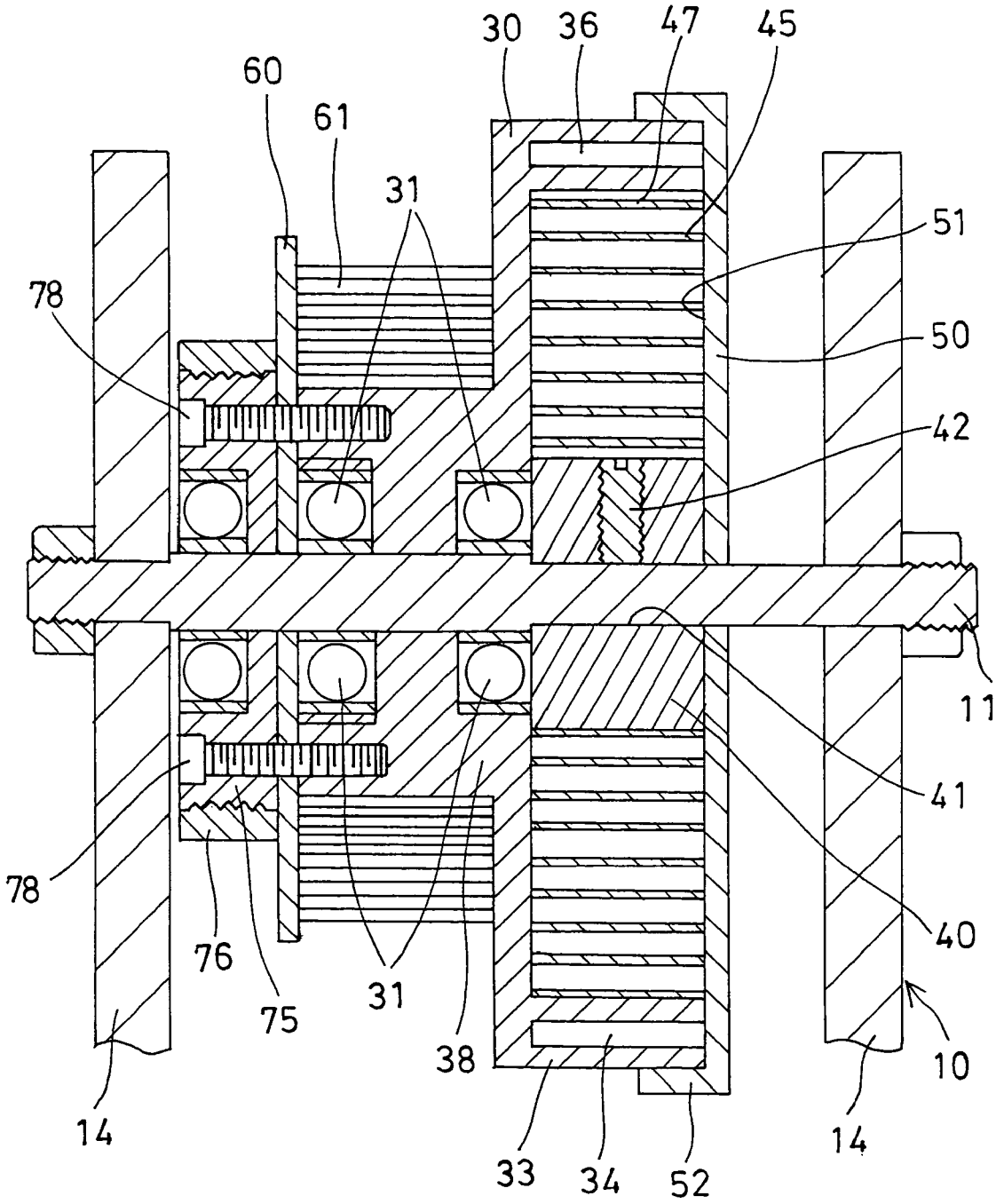
FIG. 7 is a further partial cross sectional view similar to FIGS. 2 and 5–6, illustrating a further arrangement or application of the exerciser.
Figure 8:
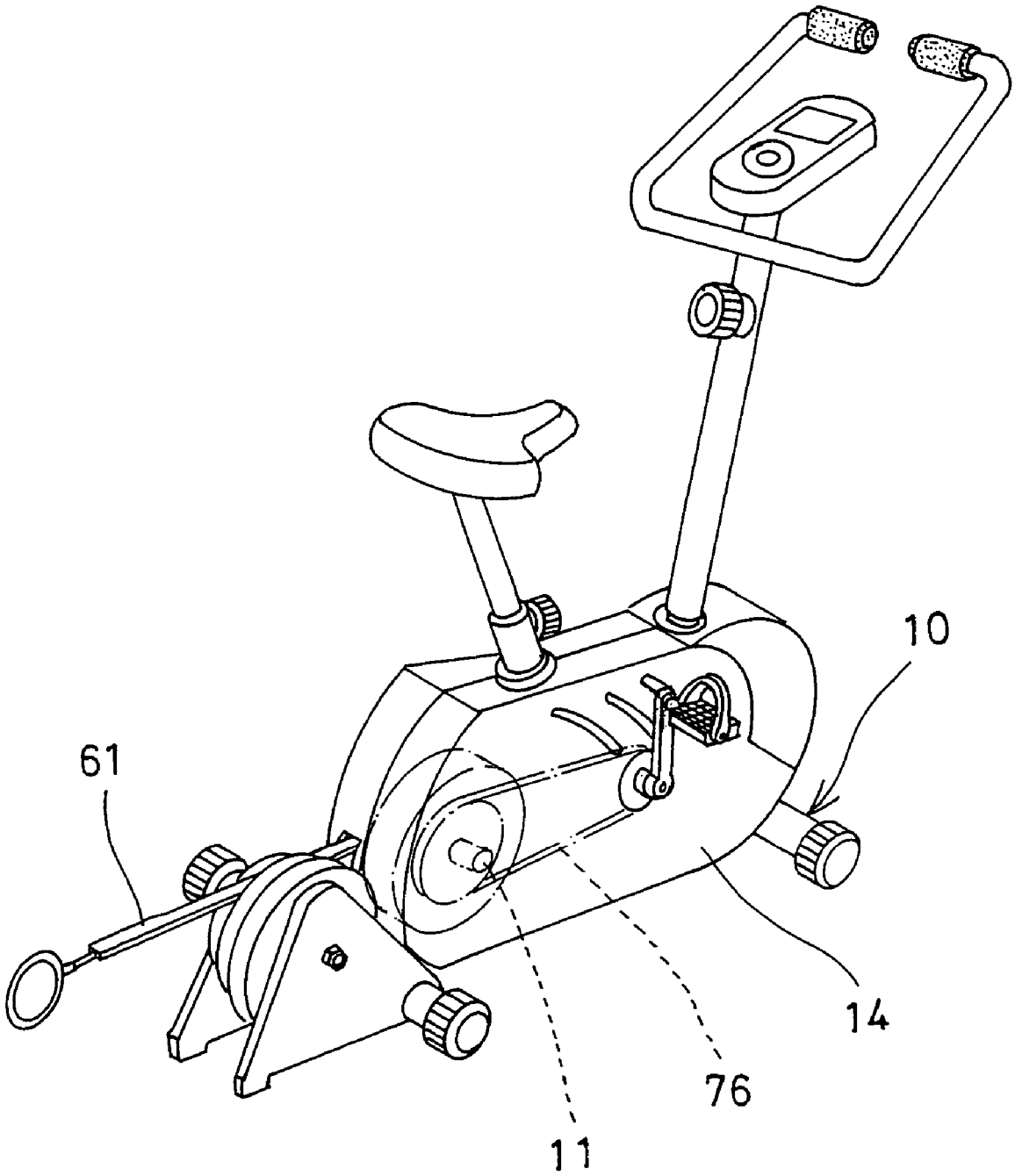
FIG. 8 is a perspective view illustrating the an exerciser having a resistive device as shown in FIG. 7.

As shown in FIGS. 7 and 8, the rotating member 75 may also be solidly secured onto the tube 38 of the housing 30 with one or more fasteners 78. A receptacle 14 may further be provided and engaged onto the housing 30 and the rotating member 75 to enclose and to shield the housing 30 and the rotating member 75 within the receptacle 14.

Accordingly, the exerciser in accordance with the present invention includes an improved resistive device having a coil spring received in a suitably enclosed housing, for allowing the coil spring to be suitably lubricated with grease or lubrication oil or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a shaft provided thereon, a housing rotatably engaged onto and supported on said shaft, and including a tube extended therefrom and rotatably engaged on said shaft, said housing including a chamber formed therein and defined by an outer peripheral wall which includes a groove formed therein, a belt engaged onto and wound around said tube of said housing, for rotating said housing relative to said shaft, a barrel received in said chamber of said housing, and secured to said shaft and rotated in concert with said shaft, said barrel including a slot formed therein, a coil spring received in said chamber of said housing, and including a first end engaged into said slot of said barrel, and a second end engaged into said groove of said outer peripheral wall of said housing, to apply a spring biasing force against said housing, and a cover including a space formed therein and defined by an outer peripheral fence, to receive said housing, and to allow said housing to be received in said space of said peripheral fence of said cover, and to allow said chamber of said housing to be suitably enclosed by said cover.

2. The exerciser as claimed in claim 1 further comprising a rotary wheel rotatably attached onto said shaft and secured to said housing.

3. The exerciser as claimed in claim 2, wherein said rotary wheel is a magnetic rotary wheel.

4. The exerciser as claimed in claim 2, wherein said housing includes an opening formed in said tube, said rotary wheel includes a hub extended therefrom and engaged into said opening of said tube of said housing, and secured to said tube.

5. The exerciser as claimed in claim 2 further comprising a rotating member rotatably attached onto said shaft and selectively secured to said housing when said rotary wheel is disengaged from said housing.

6. The exerciser as claimed in claim 1, wherein said housing includes at least one second groove formed in said outer peripheral wall thereof for selectively receiving said second end of said coil spring.

7. The exerciser as claimed in claim 6, wherein each of said groove and said at least one second groove of said housing includes a curved structure.

8. The exerciser as claimed in claim 7, wherein said groove and said at least one second groove of said housing are arranged in opposite direction.

9. The exerciser as claimed in claim 1, wherein said groove of said outer peripheral wall of said housing is formed within said outer peripheral wall of said housing and not formed through said outer peripheral wall of said housing.

10. The exerciser as claimed in claim 1, wherein said housing includes at least one flat surface formed in said outer peripheral wall thereof and having a screw hole formed therein, said cover includes at least one flat surface formed therein and having an orifice formed therein, said at least one flat surface of said cover is engaged with said at least one flat surface of said outer peripheral wall of said housing, to align said orifice of said cover with said screw hole of said housing.

11. The exerciser as claimed in claim 1, wherein said housing includes at least one cavity formed in said outer peripheral wall thereof.

12. The exerciser as claimed in claim 11, wherein said housing includes at least one partition provided in said outer peripheral wall thereof, to define said at least one cavity thereof.

13. The exerciser as claimed in claim 1 further comprising a plate secured onto said tube of said housing, to form said tube of said housing as a pulley, and to retain said belt on said tube.

14. The exerciser as claimed in claim 1, wherein said shaft includes at least one flat surface formed thereon, said barrel includes at least one flat surface formed therein and engaged with said at least one flat surface of said shaft, to secure said barrel on said shaft and to prevent said barrel from being rotated relative to said shaft.

* * * * *